US011814197B2

(12) United States Patent
Pagliarani

(10) Patent No.: US 11,814,197 B2
(45) Date of Patent: Nov. 14, 2023

(54) WRAPPING MACHINE WITH A ROTARY PLATFORM

(71) Applicant: MITEC S.R.L. CON UNICO SOCIO, Cesena (IT)

(72) Inventor: Imerio Pagliarani, Gambettola (IT)

(73) Assignee: MITEC S.R.L. CON UNICO SOCIO, Cesena (IT)

( * ) Notice: Subject to any disclaimer, the term of this patent is extended or adjusted under 35 U.S.C. 154(b) by 53 days.

(21) Appl. No.: 17/532,168

(22) Filed: Nov. 22, 2021

(65) Prior Publication Data

US 2023/0159196 A1 May 25, 2023

(51) Int. Cl.
*B65B 11/04* (2006.01)

(52) U.S. Cl.
CPC ..... *B65B 11/045* (2013.01); *B65B 2210/20* (2013.01)

(58) Field of Classification Search
CPC ... B65B 11/025; B65B 65/02; B65B 2210/16; B65B 2210/18; B65B 2210/20
See application file for complete search history.

(56) References Cited

U.S. PATENT DOCUMENTS 4,905,448 A * 3/1990 Plitt ..... B65B 11/025 53/399
5,212,933 A * 5/1993 Cere' ..... B65B 11/045 53/556
11,518,556 B2 * 12/2022 Paoli ..... B65B 65/02
2002/0056259 A1 * 5/2002 DeGrasse ..... B65B 11/045 53/556
2009/0235617 A1 * 9/2009 Moore ..... B65B 11/045 53/461
2020/0180798 A1 * 6/2020 Paoli ..... B65B 11/045

FOREIGN PATENT DOCUMENTS

| | | | |
|---|---|---|---|
| DE | 3615450 | 11/1987 | |
| DE | 3615450 A * | 11/1987 | ..... B65B 11/045 |
| DE | 60311819 | 5/2004 | |
| EP | 0279871 | 2/1987 | |
| EP | 0399046 | 10/1989 | |
| EP | 0559994 | 3/1992 | |
| FR | 2499020 | 8/1982 | |
| WO | 2018220503 | 12/2018 | |

OTHER PUBLICATIONS

Italian Search Report and Written Opinion dated Nov. 10, 2020, in connection with Italian Application No. 202000004228 (9 pages).

* cited by examiner

*Primary Examiner* — Andrew M Tecco
(74) *Attorney, Agent, or Firm* — MCCRACKEN & GILLEN LLC

(57) ABSTRACT

A wrapping machine with a rotary platform to wrap products with at least one band of wrapping material has a base, a rotary platform, which defines a support surface for at least one product and is mounted so as to rotate around a rotation axis, and a support slide, which is configured to receive and hold a spool of the band of wrapping material and is movable along a guide upright, which is mounted so as to rotate around the rotation axis with a rotation direction that is contrary to a rotation direction of the rotary platform.

9 Claims, 6 Drawing Sheets

WRAPPING MACHINE WITH A ROTARY PLATFORM

CROSS-REFERENCE TO RELATED APPLICATIONS

This patent application is related to Italian patent application No. 102020000004228 filed on Feb. 28, 2020, the entire disclosure of which is incorporated herein by reference.

TECHNICAL FIELD

The invention relates to a wrapping machine with a rotary platform.

In particular, the invention relates to a wrapping machine to wrap products with at least one band of wrapping material.

BACKGROUND ART

When dealing with the wrapping of products in wrapping material bands, a wrapping machine is known, which comprises a base; a rotary platform, which defines a support surface for at least one product and is mounted on the base so as to rotate around a rotation axis, which is substantially vertical and perpendicular to the support surface; and a plurality of support rollers, which are interposed between the base and the rotary platform and are distributed around the aforesaid rotation axis.

The wrapping machine further comprises a guide upright, which projects upwards from the base and extends in a vertical direction, which is substantially parallel to the rotation axis of the rotary platform; and a support slide, which is configured to receive and hold a spool of wrapping material and is movable along the guide upright so as to wrap the wrapping material band in a spiral around the products combining the movements of the rotary platform around the rotation axis and the movements of the support slide along the guide upright.

Since the guide upright is fixed and the rotation speed of the platform cannot exceed a threshold value set by safety standards in force, known wrapping machines of the type described above have a relatively long operating cycle, during which each product is wrapped in the relative wrapping material band, and, as a consequence, a reduced productivity.

DISCLOSURE OF INVENTION

The object of the invention is to provide a wrapping machine with a rotary platform, which does not suffer from the drawbacks discussed above and can be actuated in a straightforward, relatively low-cost manner.

According to the invention there is provided a wrapping machine with a rotary platform according to the appended claims.

BRIEF DESCRIPTION OF THE DRAWINGS

The invention will now be described with reference to the accompanying drawings showing a non-limiting embodiment thereof, wherein.

BEST MODE FOR CARRYING OUT THE INVENTION

Figure 1:
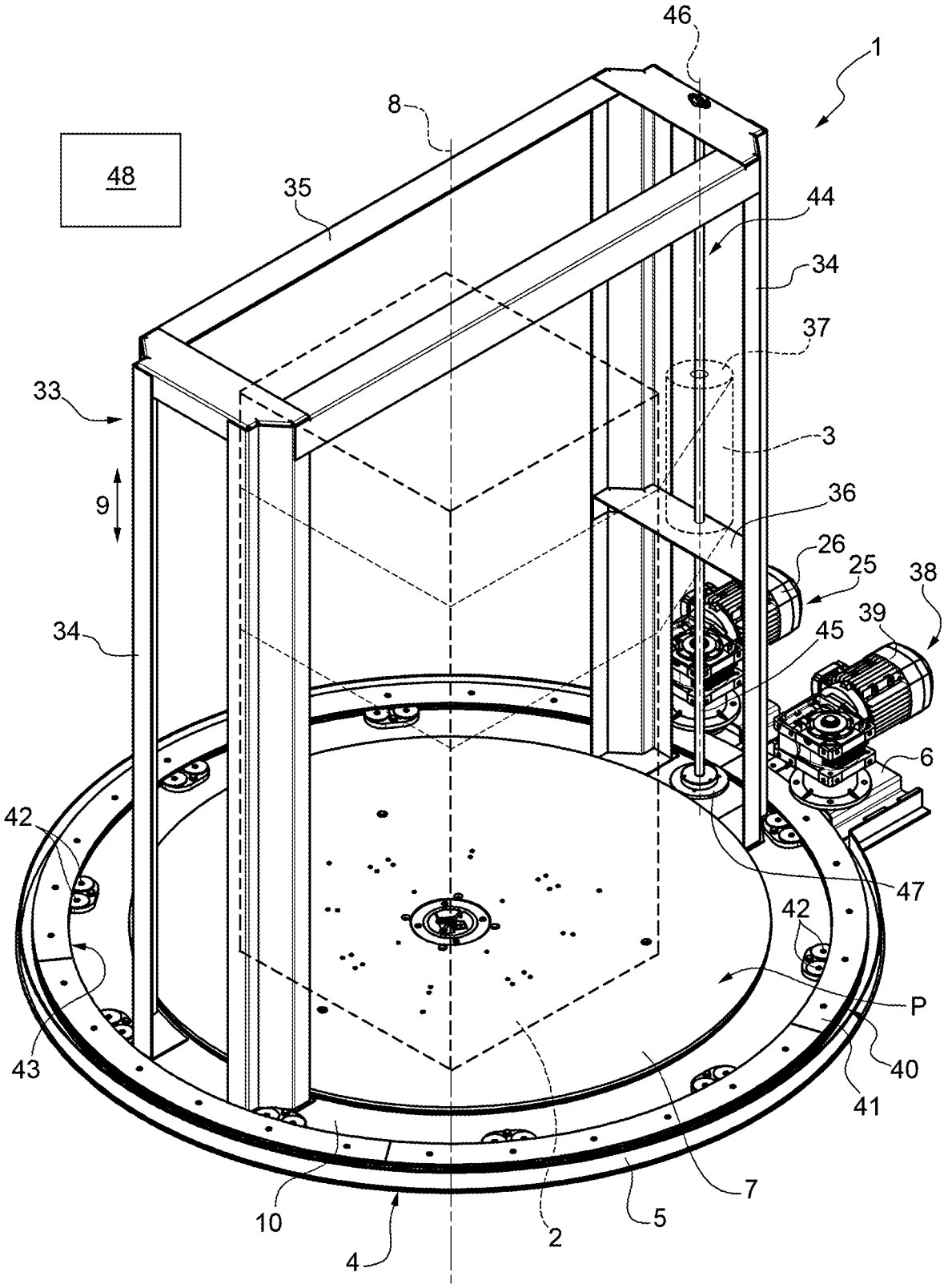
FIG. 1 is a schematic perspective view, with parts removed for greater clarity, of a preferred embodiment of the wrapping machine according to the invention.

With reference to FIGS. 1 to 6, number 1 indicates, as a whole, a wrapping machine to wrap products 2 in a band 3 of wrapping material, in this specific case a stretch film.

The wrapping machine 1 comprises a substantially flat base 4 comprising, in turn, a substantially circular plate 5 and a substantially rectangular board 6, which are connected to one another.

The wrapping machine 1 further comprises a rotary platform 7, which has a circular shape, defines a substantially horizontal support surface P for at least one product 2 and is mounted above the plate 5 so as to rotate, relative to the base 4, around a rotation axis 8, which is substantially parallel to a vertical direction 9.

The wrapping machine 1 further has a feeding disc 10, which is mounted between the plate 5 and the platform 7 coaxially to the axis 8 and radially projects from the platform 7.

The disc 10 is coupled to the base 4 in a rotary manner through the interposition of a plurality of centring wheels 11 (FIGS. 5 and 6), which are uniformly distributed around the axis 8 and along a lower annular flange 10*a* of the disc 10, project upwards from the plate 5 and are mounted so as to rotate around respective rotation axes 12, which are parallel to one another and to the direction 9.

The wrapping machine 1 further comprises two roller cages 13, 14, the cage 13 being mounted between the plate 5 and the disc 10 and the cage 14 being mounted between the disc 10 and the platform 7.

The cage 13 comprises an annular support plate 15 (FIG. 5), which is mounted coaxially to the axis 8 and is coupled to the base 4 in a rotary manner through the interposition of a plurality of centring wheels 16, which are uniformly distributed around the axis 8 and along an inner peripheral edge of the plate 15, project upwards from the plate 5 and are mounted so as to rotate around respective rotation axes 17, which are parallel to one another and to the direction 9.

The cage 13 is further provided with a plurality of rollers 18, which are mounted through the plate 15, are distributed around the axis 8 and are coupled to the plate 15 in a rotary manner so as to rotate, relative to the plate 15, around respective rotation axes 19, which are substantially radial and transverse to the axis 8.

The rollers 18 have a diameter which is substantially equal to a distance between the plate 5 and the disc 10, measured parallel to the direction 9, so that they are in contact both with the plate 5 and with the disc 10.

The cage 14 comprises an annular support plate 20 (FIGS. 2 and 3), which is mounted coaxially to the axis 8 and is coupled to the base 4 in a rotary manner through the interposition of a plurality of centring wheels 21, which are uniformly distributed around the axis 8 and along an inner peripheral edge of the plate 20, project downwards from the platform 7 and are mounted so as to rotate around respective rotation axes 22, which are parallel to one another and to the direction 9.

The cage 14 is further provided with a plurality of rollers 23, which are mounted through the plate 20, are distributed around the axis 8 and are coupled to the plate 20 in a rotary manner so as to rotate, relative to the plate 20, around respective rotation axes 24, which are substantially radial and transverse to the axis 8.

The rollers 23 have a diameter which is substantially equal to a distance between the disc 10 and the platform 7, measured parallel to the direction 9, so that they are in contact both with the disc 10 and with the platform 7.

The disc 10 and the platform 7 are moved around the axis 8, with rotation directions that are contrary to one another, by an operating assembly 25 comprising an electric motor 26, which is fixed to the board 6 and has an output shaft, which is provided with a gear 49 coupled to a crown wheel 27 (FIGS. 3 and 4), which is obtained along an outer peripheral edge of the disc 10.

The assembly 25 further comprises a transmission device 28 to transmit the rotation motion of the disc 10 to the platform 7.

The device 28 comprises a crown wheel 29 (FIGS. 2, 3 and 4) obtained along an inner peripheral edge of the disc 10; a crown wheel 30 (FIG. 2), which is obtained on a lower annular flange 7*a* of the platform 7 and extends into the crown wheel 29; and a plurality of gears 31 (FIGS. 2-5), which are interposed between the crown wheel 29 and the crown wheel 30, project upwards from the plate 5 and are mounted so as to rotate around respective rotation axes 32, which are parallel to one another and to the direction 9.

With regard to what explained above, it should be pointed out that, when the disc 10 is moved by the motor 26 around the axis 8 with a given rotation direction, the platform 7 is moved by the gears 31 around the axis 8 with a rotation direction that is contrary to the one of the disc 10.

The disc 10 supports a gantry 33 comprising two vertical uprights 34, which extend upwards from the disc 10 in the direction 9, are diametrically opposite one another relative to the axis 8 and carry, connected to their free ends, a horizontal cross member 35, which is transverse to the uprights 34.

One of the uprights 34 supports a bracket 36, which is coupled to the upright 34 in a sliding manner and is configured to receive and hold a spool 37 of band 3.

The bracket 36 is movable along the relative upright 34 in the direction 9 so as to wrap the band 3 in a spiral around the product 2 combining the movements of the platform 7 and of the gantry 33 around the axis 8 with the movements of the bracket 36 and, hence, of the spool 37 in the direction 9.

Figure 2:
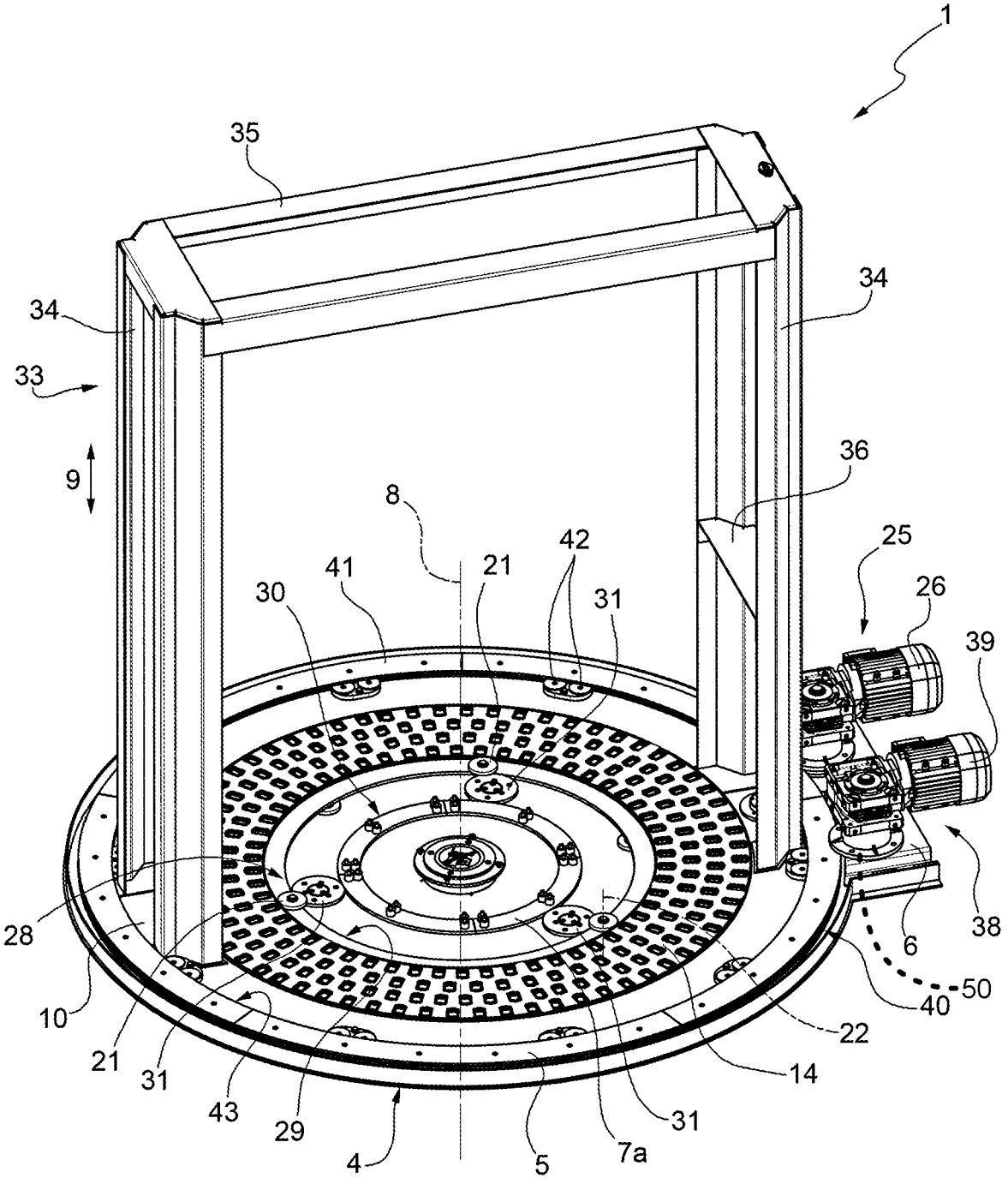
FIG. 2 is a schematic perspective view, with parts removed for greater clarity, of a detail of the wrapping machine of FIG. 1.
Figure 3:
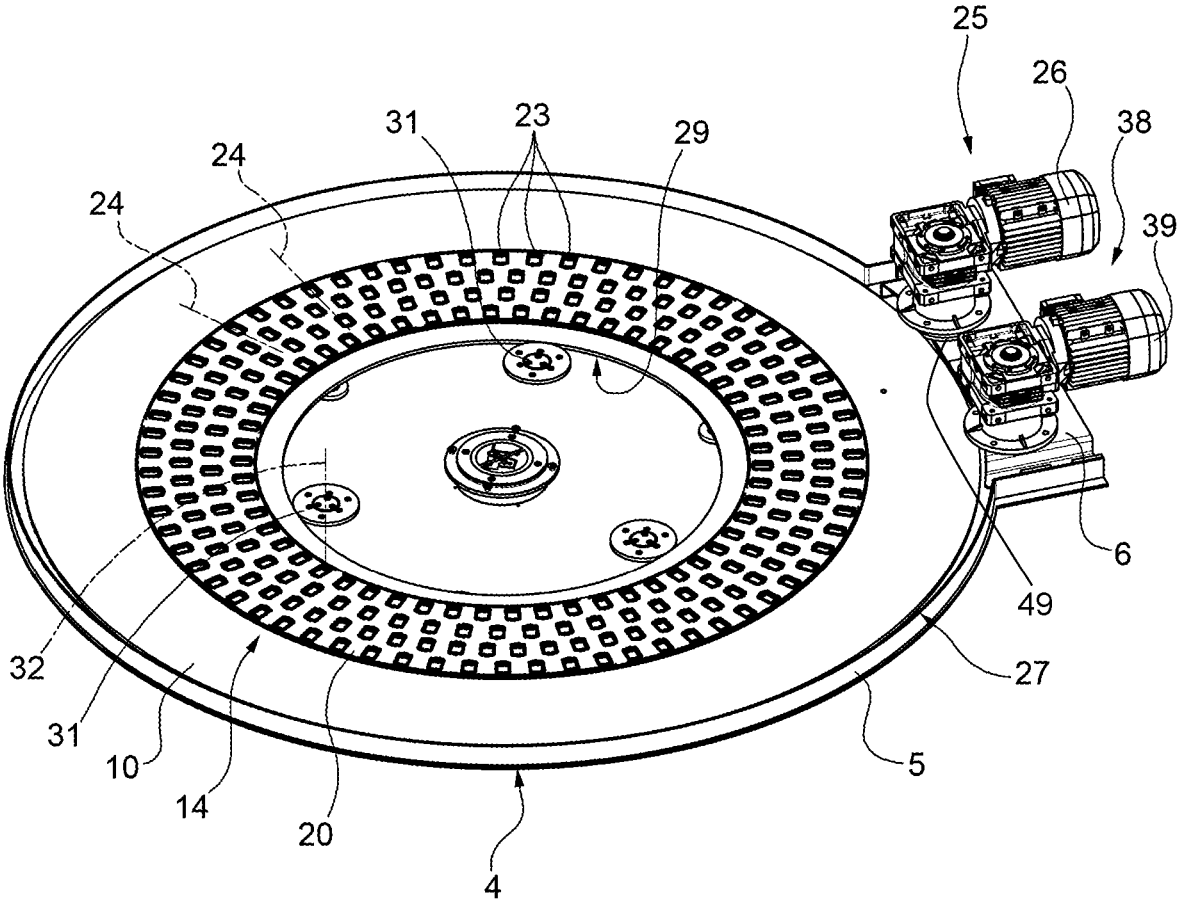
FIG. 3 is a schematic perspective view, with parts removed for greater clarity, of a detail of FIG. 2.
Figure 4:
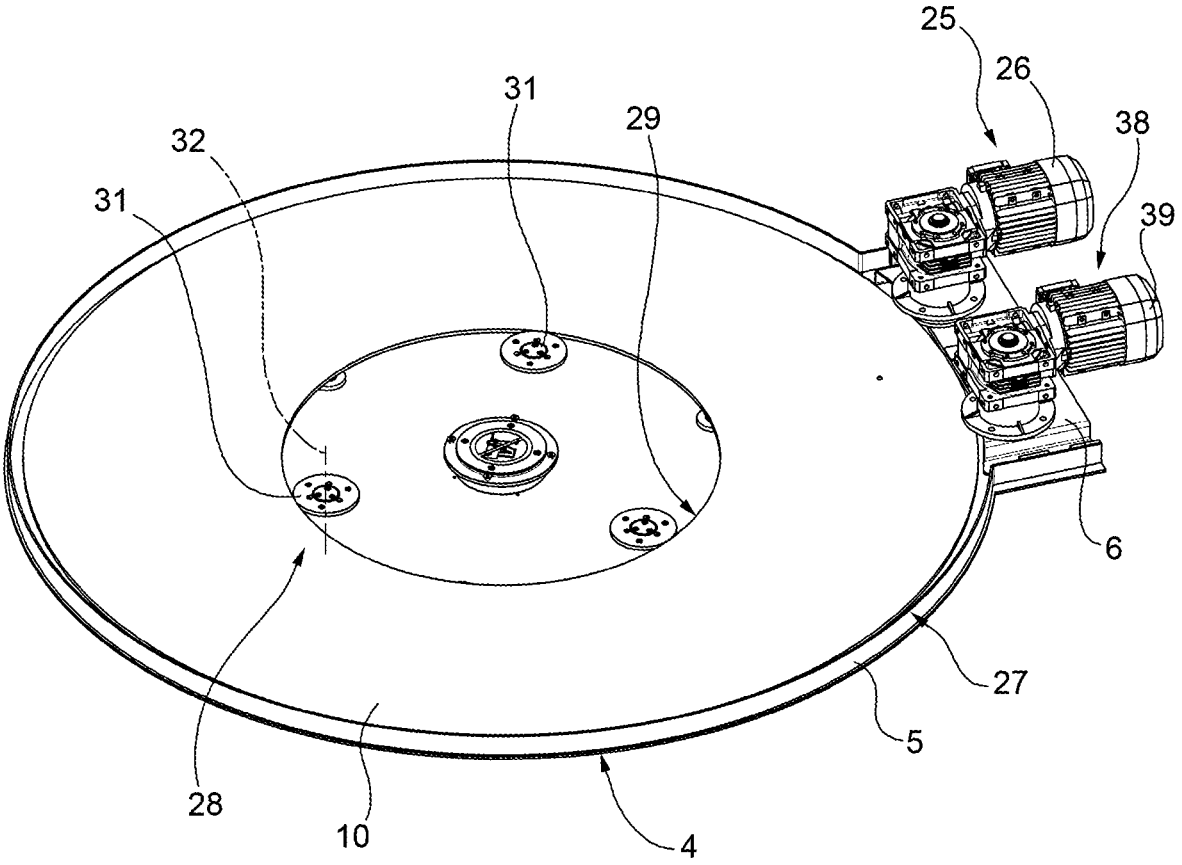
FIG. 4 is a schematic perspective view, with parts removed for greater clarity, of a detail of FIG. 3.
Figure 5:
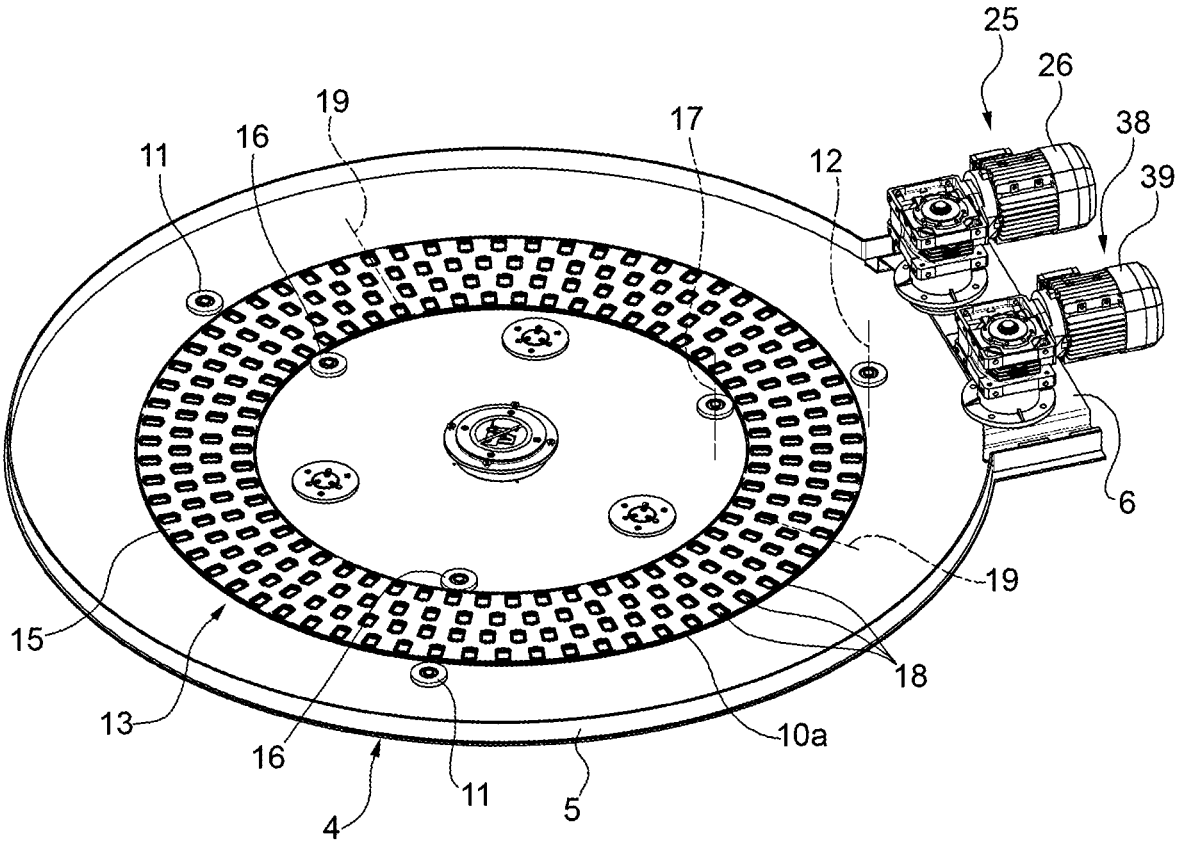
FIG. 5 is a schematic perspective view, with parts removed for greater clarity, of a detail of FIG. 4.
Figure 6:
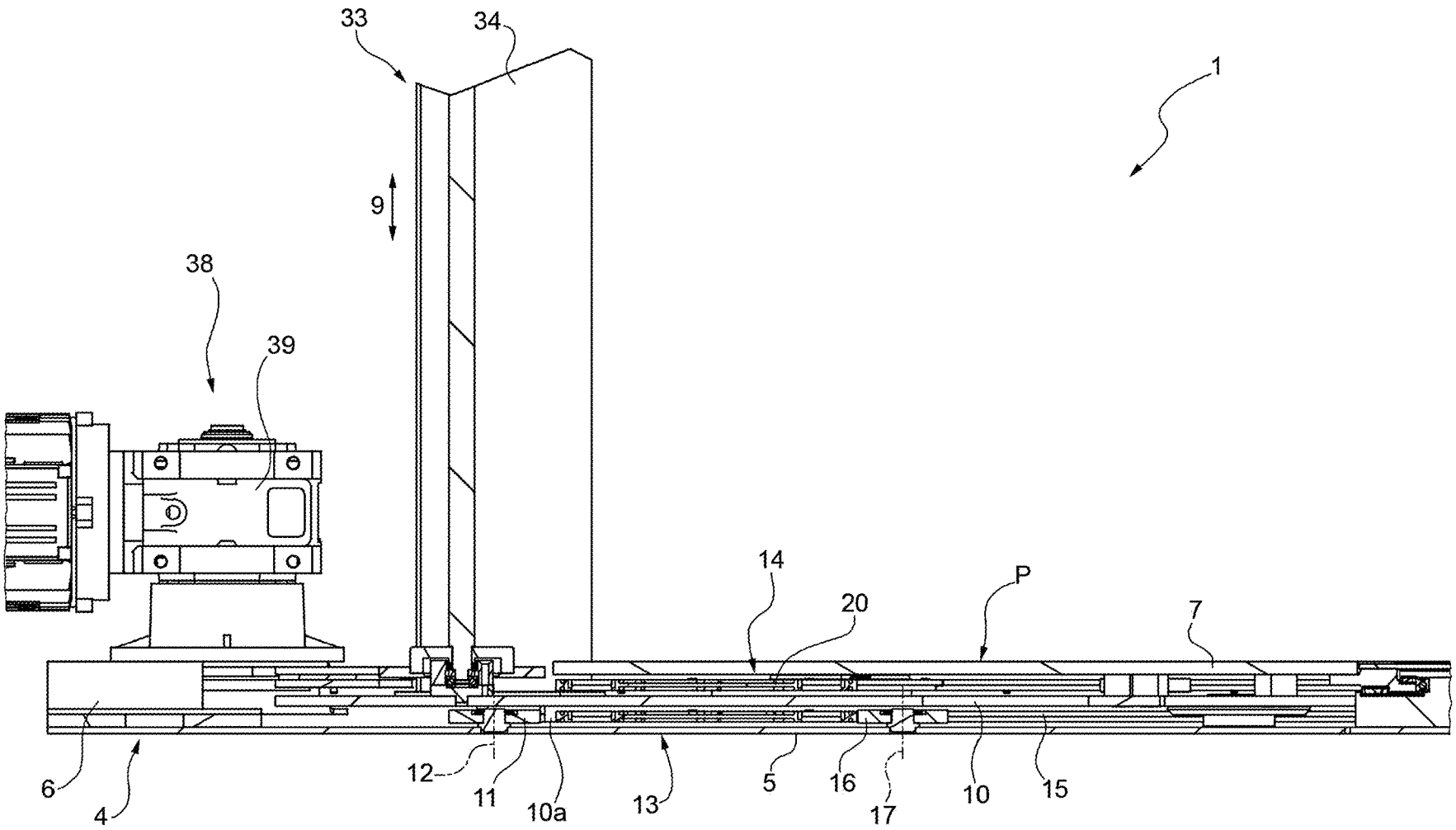
FIG. 6 is a schematic sectional view, with parts removed for greater clarity, of a detail of the wrapping machine of FIG. 1.

The bracket 36 is moved along the relative upright 34 in the direction 9 by an operating assembly 38 comprising an electric motor 39, which is fixed to the board 6 and has an output shaft, which is provided with a gear 50 coupled to a crown wheel 40, which is obtained along an outer peripheral edge of a transmission ring 41 (FIGS. 1 and 2).

The ring 41 is mounted coaxially to the axis 8 and is coupled to the disc 10 in a rotary manner through the interposition of a plurality of pairs of centring wheels 42 (FIGS. 1 and 2), which are mounted on the disc 10 and are distributed around the axis 8.

The ring 41 is further provided with a crown wheel 43 (FIGS. 1 and 2) obtained along an inner peripheral edge of its and defines part of a transmission device 44, which is designed to connect the motor 39 and the bracket 36 to one another.

The device 44 further comprises a transmission screw 45, which is coupled in a rotary manner to the disc 10 and to the relative upright 34, so as to rotate, relative to the gantry 33, around a rotation axis 46 parallel to the axis 8, and is further coupled to the bracket 36 through a screw-nut screw coupling.

The screw 45 is provided with a gear 47 (FIGS. 1 and 2), which is splined on a lower end of the screw 45 and is coupled to the crown wheel 43.

The wrapping machine 1 finally comprises an electronic control unit 48, which is configured to selectively control the motors 26 and 39 in such a way that:

- when the disc 10 and the ring 41 have the same rotation speed around the axis 8, the assembly consisting of the gear 47, the screw 45 and the bracket 36 is still; and
- when the disc 10 and the ring 41 have respective rotation speeds around the axis 8 which are different from one another, the gear 47 and the screw 45 are moved around the axis 46 and the bracket 36 is moved along the screw 45 in the direction 9.

The wrapping machine 1 offers some advantages, which are mainly due to the fact that, by combining the movements of the platform 7 and of the gantry 33 around the axis 8 with respective rotation directions that are contrary to one another, the wrapping machine 1 has a relatively short operating cycle, during which each product 2 is wrapped in the relative band 3, and, as a consequence a relatively high productivity.

Furthermore, the wrapping machine 1 offers a further advantage lying in the fact that the electric motor 39 operating the bracket 36 is fixed to the board 6 of the base 4 and the transmission device 44 is mechanical, hence it does not require the use of electrical power supply cables and/or of power supply batteries and/or of electrical sliding contacts.

The invention claimed is:

1. A wrapping machine with a rotary platform to wrap products with at least one band of wrapping material; the wrapping machine comprising a base; a rotary platform, which defines a support surface for at least one product and is mounted on the base so as to rotate around a rotation axis that is substantially perpendicular to the support surface; a first upright, which is substantially parallel to the rotation axis; a first operating motor to move the rotary platform and the first upright around the rotation axis and a first transmission device to transmit the rotation motion between the rotary platform and the first upright a feeding disc, which is mounted so as to rotate around the rotation axis and is provided with a first crown wheel coupled to a first gear operated by the first operating motor and the first upright being carried by the feeding disc; a first roller cage comprising an annular first support plate mounted between the feeding disc and the rotary platform and a plurality of first support rollers coupled to the first support plate in a rotary manner and arranged in contact with the feeding disc and with the rotary platform; and a support slide, which is configured to receive and hold a spool of the band of wrapping material and is movable along the first upright; and being characterized in that the first upright is mounted so as to rotate around the rotation axis with a rotation direction that is contrary to a rotation direction of the rotary platform.

2. A wrapping machine according to claim 1, wherein the first operating motor is coupled to the first upright and the first transmission device is configured to transmit the rotation motion from the first upright to the rotary platform.

3. A wrapping machine according to claim 1, wherein the first transmission device comprises a second crown wheel obtained on the feeding disc, a third crown wheel obtained on the rotary platform within the second crown wheel, and a plurality of second gears interposed between said second and third crown wheels.

4. A wrapping machine according to claim 1, wherein the first upright defines part of a gantry further comprising a second upright, which is substantially parallel to the rotation axis and diametrically opposite the first upright relative to the first rotation axis, and a cross member connecting the free ends of said first and second uprights to one another.

5. A wrapping machine with a rotary platform to wrap products with at least one band of wrapping material; the wrapping machine comprising a base; a rotary platform, which defines a support surface for at least one product and is mounted on the base so as to rotate around a rotation axis that is substantially perpendicular to the support surface; a first upright, which is substantially parallel to the rotation axis; a first operating motor to move the rotary platform and the first upright around the rotation axis and a first transmission device to transmit the rotation motion between the rotary platform and the first upright a feeding disc, which is mounted so as to rotate around the rotation axis and is provided with a first crown wheel coupled to a first gear operated by the first operating motor, and the first upright being carried by the feeding disc; a first roller cage comprising an annular first support plate mounted between the feeding disc and the rotary platform and a plurality of first support rollers coupled to the first support plate in a rotary manner and arranged in contact with the feeding disc and with the rotary platform; a second roller cage comprising a second annular support plate mounted between the base and the feeding disc and a plurality of second support rollers coupled to the second support plate in a rotary manner and arranged in contact with the base and with the feeding disc; and a support slide, which is configured to receive and hold a spool of the band of wrapping material and is movable along the first upright and being characterized in that the first upright is mounted so as to rotate around the rotation axis with a rotation direction that is contrary to a rotation direction of the rotary platform.

6. A wrapping machine with a rotary platform to wrap products with at least one band of wrapping material; the wrapping machine comprising a base; a rotary platform, which defines a support surface for at least one product and is mounted on the base so as to rotate around a rotation axis that is substantially perpendicular to the support surface; a first upright, which is substantially parallel to the rotation axis; a support slide, which is configured to receive and hold a spool of the band of wrapping material and is movable along the first upright; a first operating motor to move the rotary platform and the first upright around the rotation axis and a first transmission device to transmit the rotation motion between the rotary platform and the first upright and a second operating motor and a second transmission device to connect the second operating motor and the support slide and to move the support slide along the first upright and being characterized in that the first upright is mounted so as to rotate around the rotation axis with a rotation direction that is contrary to a rotation direction of the rotary platform, wherein the second transmission device comprises a transmission ring, which is coupled to the base in a rotary manner so as to rotate around the rotation axis, is provided with a first crown wheel coupled to a first gear operated by the second operating motor, and is further provided with a second crown wheel, which is coaxial to the rotation axis; and a transmission screw, which is coupled to the first upright in a rotary manner so as to rotate around a further rotation axis parallel to the rotation axis, and is further coupled to the second crown wheel through the interposition of a second gear, which is integral to the transmission screw.

7. A wrapping machine according to claim 6, wherein the second operating motor is integral to the base and the second transmission device is mechanical.

8. A wrapping machine according to claim 6, wherein the support slide and the transmission screw are coupled to one another through a screw-nut screw mechanism.

9. A wrapping machine according to claim 6, and further comprising an electronic control unit, which is configured to selectively control said first and second operating motors so as to move the first upright and the transmission ring around the rotation axis with the same rotation speed or with different rotation speeds.

* * * * *